US007681766B2

(12) United States Patent
Harrison, III et al.

(10) Patent No.: US 7,681,766 B2
(45) Date of Patent: Mar. 23, 2010

(54) INTERCHANGEABLE SHOULDER MOUNTABLE ARTICLE CARRYING DEVICE

(76) Inventors: Howard W. Harrison, III, 16 S. 20th St., Philadelphia, PA (US) 19103; Donald S. Urash, 315 E. 5th St., #6F, New York, NY (US) 10003

( * ) Notice: Subject to any disclaimer, the term of this patent is extended or adjusted under 35 U.S.C. 154(b) by 1025 days.

(21) Appl. No.: 11/206,338

(22) Filed: Aug. 18, 2005

(65) Prior Publication Data

US 2007/0039983 A1 Feb. 22, 2007

(51) Int. Cl.
*A45F 3/10* (2006.01)
*A45F 5/00* (2006.01)

(52) U.S. Cl. ..... 224/265; 224/266; 224/270; 224/268; 224/907; 224/925

(58) Field of Classification Search ..... 224/201, 224/264, 265, 266, 270, 907, 925, 905, 272; 223/89, 90, 94; 294/23.5, 159, 160, 167, 294/169, 170, 171, 141, 142, 143, 146, 149, 294/153, 156, 158; 482/140, 148; 16/406
See application file for complete search history.

(56) References Cited

U.S. PATENT DOCUMENTS

| | | | | | |
|---|---|---|---|---|---|
| 399,180 | A | | 3/1889 | Bridwell | |
| 966,562 | A | | 8/1910 | Knoerzer | |
| 1,246,587 | A | * | 11/1917 | Giardino | 294/169 |
| 1,336,375 | A | * | 4/1920 | Owen | 223/90 |
| 1,979,687 | A | * | 11/1934 | Hall | 223/94 |
| 2,112,947 | A | * | 4/1938 | Zemba | 223/88 |
| 2,986,314 | A | | 5/1961 | Miller | |
| D194,962 | S | | 4/1963 | O'Link | |
| 3,682,358 | A | * | 8/1972 | Richey | 224/201 |
| 3,820,781 | A | | 6/1974 | Kane | |
| 3,848,787 | A | | 11/1974 | Hill | |
| 4,879,768 | A | * | 11/1989 | McClees et al. | 224/264 |
| 5,312,314 | A | | 5/1994 | Stephan et al. | |
| 5,361,956 | A | * | 11/1994 | Recanati | 224/257 |
| 5,495,968 | A | * | 3/1996 | Miller | 224/266 |
| 5,667,266 | A | * | 9/1997 | Giocanti | 294/170 |
| 5,687,888 | A | * | 11/1997 | Chang | 223/94 |
| 6,045,019 | A | * | 4/2000 | Moses | 224/257 |
| 6,499,781 | B1 | * | 12/2002 | Flynn | 294/159 |
| 2004/0029689 | A1 | * | 2/2004 | Contreras | 482/148 |

* cited by examiner

*Primary Examiner*—Nathan J Newhouse
*Assistant Examiner*—Steven M Landolfi, Jr.
(74) *Attorney, Agent, or Firm*—James E. Larson

(57) ABSTRACT

An article carrying device is provided for balancing upon a single shoulder of a person. The device includes front and back extended end members having a plurality of clips provided along middle and distal portions of the ends members. The clips secure packages to the article carrying device such that when packages of equal weights are attached to both ends of the carrying device, the device balances upon the shoulder of the person and does not require human hand intervention to maintain its position. The article carrying device is interchangeable and can be employed on either shoulder of the person. A hinge mechanism can be provided at an apex of the device for permitting the collapse of said device for transport or storage when not is use.

10 Claims, 5 Drawing Sheets

INTERCHANGEABLE SHOULDER MOUNTABLE ARTICLE CARRYING DEVICE

BACKGROUND OF THE INVENTION

1. Field of the Invention

The present invention relates to a shoulder mountable article carrying device. More particularly, it relates to a shoulder mountable article carrying device balanced on a single shoulder of a person for carrying packages or other objects and articles of substantially equal weight without requiring the use of human hand intervention to stabilize the articles, and which can be interchanged for use on either shoulder of the person.

2. Description of the Prior Art

Devices which can be balanced on the shoulders of a person are well known in the prior art. One such device is known as a yoke and is balanced upon the two shoulder blades of a person around the back of their neck. The yoke has two elongated portions extending out from a middle portion for resting upon the shoulders of the person. The yoke is constructed such that evenly weighted opposed ends extend outward from the neck area of the person creating an evenly balanced device. Accordingly, the weight of the yoke is set such that it's center of gravity is positioned at a middle portion where the device wraps around the back of the person's neck. This enables the person to carry substantially equal weighted loads on the opposed ends of the yoke while maintaining balance and not requiring the use of their hands to keep the device balanced and stabilized on their neck. However, the outwardly extending opposed ends creates a substantially wide profile and causes the person utilizing such a device to interfere with his surroundings to his left and right sides.

Other forms of yokes are known in the prior art and are used for exercise purposes. Such devices can be seen in U.S. Pat. Nos. 3,820,781 (the '781 patent) and Pat. No. 5,312,314 (the '314 patent). Both devices have elongated wing portions for resting upon the shoulder blades of the person. The '314 patent is not made to carrying packages, yet is configured to add weight on both ends such that a person can increase strength as they use the device.

Carrying yokes are known and can be seen in U.S. Pat. Nos. 399,180 and 966,562. Both of these devices have extended wing portions that rest upon the shoulder blades of the person with opposed ends that permit weighted objects to be carried thereupon. Another type of carrying device can be seen in U.S. Pat. No. 3,848,787. This device has a backwardly extending portion, a shoulder resting portion and a downwardly extending front portion with a hand grip. Packages or other weighted objects are positioned upon the backwardly extending portion while the hand of the user grips the downwardly extending front portion to properly balance the device. The device rests upon a single shoulder. If the user does not grip the front portion, the device will not balance properly.

None of the carrying devices seen in the prior have outwardly extending portions that permit the device to rest upon a single shoulder and balance thereupon without the use of external forces such as the hand of the user. There is a need for shoulder mounted carrying device for use upon a single shoulder that balances thereupon without the need to rest around the neck of the user. Further, the carrying device should extend out and back from the shoulder perpendicular to the body of the user and not require any external force to balance the device upon the shoulder of the user (i.e., human hands). By extending front to back instead of side to side, as in the prior art, a user would be able to eliminate the interference caused by these known side to side devices.

SUMMARY OF THE INVENTION

We have invented an improved shoulder mounted carrying device for use on a single shoulder of a person. Our device is interchangeable between the two shoulders of a person. The device includes an elongated member having a front and back end member and a middle portion. The middle portion includes a pad mounted upon a bottom surface for providing comfort to the user and his shoulder. The middle portion bows upward providing a contour for resting upon the shoulder. The front and back members extend outwardly therefrom such that the front end is perpendicular to the person's chest and the back end is perpendicular to the person's back when employed on one of his shoulders. The front and back end members are integrally attached to the middle portion in a preferred embodiment. The front and back end members bow downward from the middle portion and then upward near their distal ends for lowering the center of gravity and assisting in stabilizing the device upon the single shoulder.

A hinge element is provided at the middle portion for collapsing the device to a smaller size for convenient storage. A plurality of clip elements are attached to each end of the front and back members and are used to secure packages and other objects or articles to the present article carrying device. To maintain proper balance, packages and items of a generally equal weight should be supported on both ends. If of substantially equal weight, no external forces, such as the hand of the user, need be used to maintain proper balance for the items carried thereupon.

And, due to the two opposed ends extending to the front and back of the person, instead of side to side, the novel device of the subject invention eliminates the deficiency seen in the prior art wherein significant interference occurs on either side of both shoulders.

BRIEF DESCRIPTION OF THE DRAWINGS

The invention may be best understood by those having ordinary skill in the art by reference to the following detailed description when considered in conjunction with the accompanying drawings in which.

DETAILED DESCRIPTION OF THE INVENTION

Figure 1:
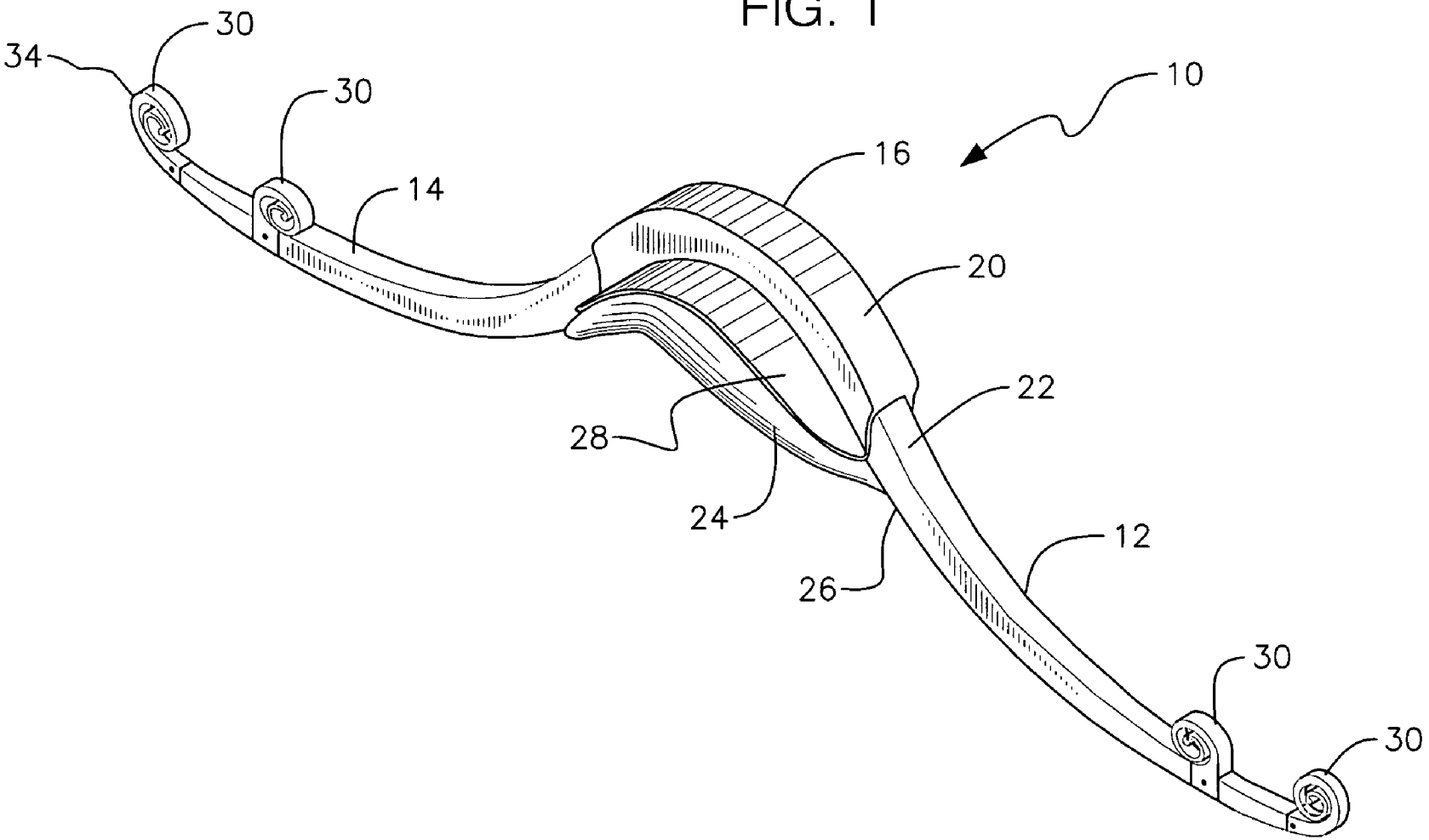
FIG. 1 is a perspective view of the interchangeable shoulder mountable article carrying device of the present invention.

Throughout the following detailed description, the same reference numerals refer to the same elements in all figures.

Figure 3:
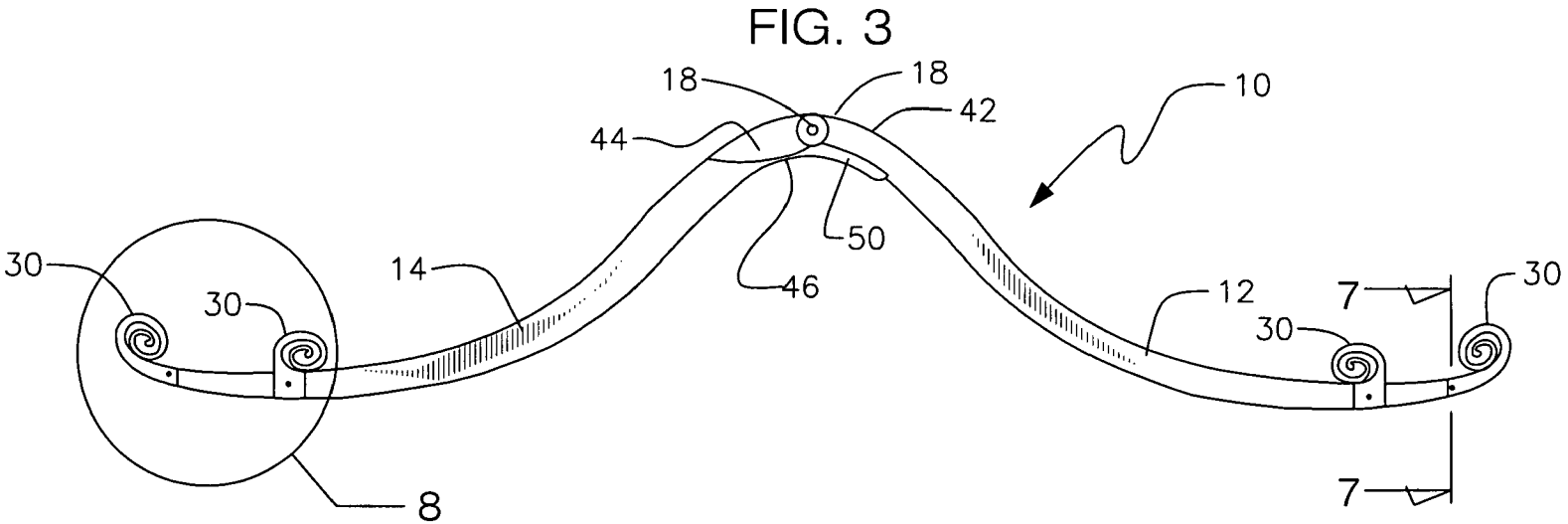
FIG. 3 is a right side view of the present invention illustrating a hinge mechanism positioned at a middle section thereof for use in opening and collapsing the device.

Referring to FIG. 1, an interchangeable shoulder mountable article carrying device 10 of the present invention is depicted. As shown, carrying device 10 includes a pair of outwardly extending opposed front and back end members, 12 and 14 respectively. Front and back end members 12 and 14 are attached to one another at a middle portion 16. Front and back end members 12 and 14 can be affixed by a hinge mechanism 18 (as shown in FIG. 3) or integrally attached such that carrying device 10 is constructed as one complete static piece.

Figure 2:
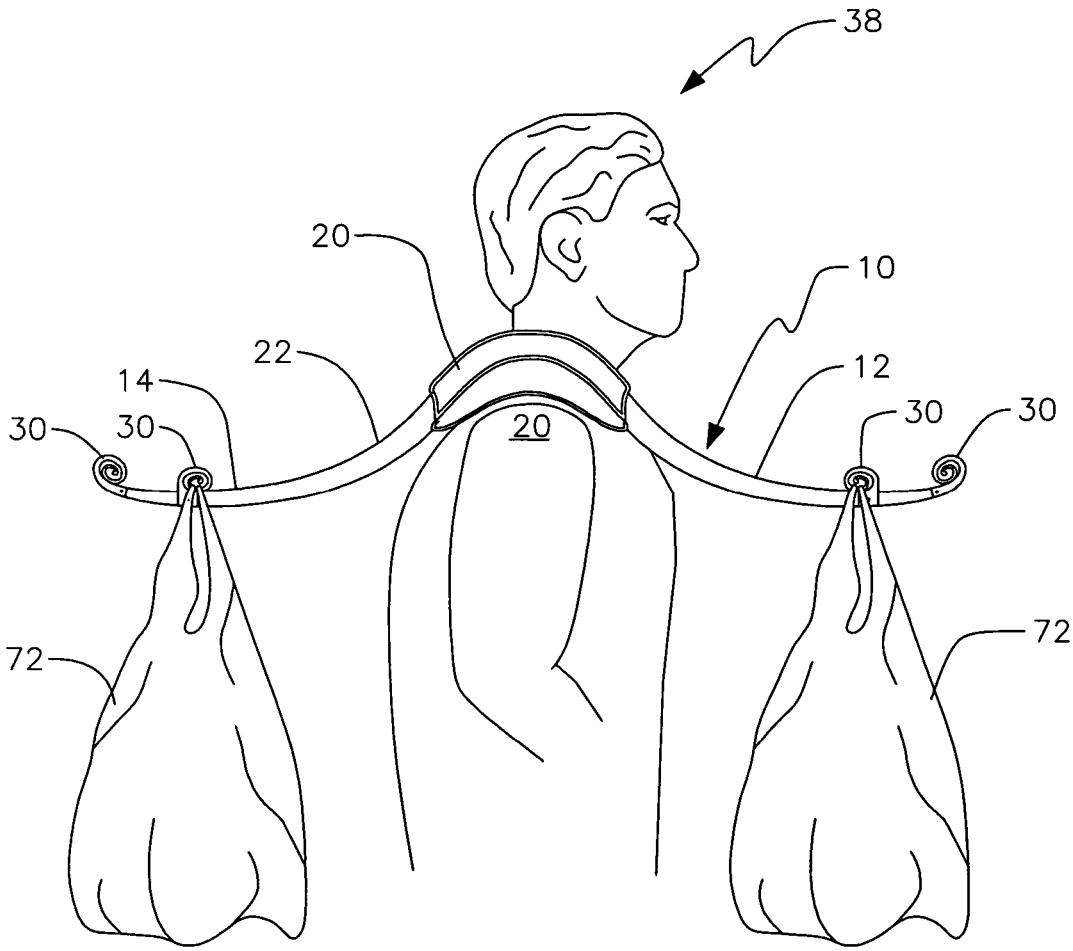
FIG. 2 is a right side view of the interchangeable shoulder mountable article carrying device of the present invention employed on the shoulder of a person and in use.

Further to FIG. 1, a cap element 20 can be attached on a top side 22 of middle portion 16 (also shown in FIG. 2). Cap element 20 employs a pad 24 which extends underneath a bottom side 26 of middle portion 16 thereby providing cushioning to the shoulder of a person utilizing carrying device 10. Cap element 20 is affixed to carrying device 10 by a friction fit in the preferred embodiment. However, in alternate embodiments, cap 24 can attach by a hook and loop closure system (i.e., Velcro®), snap and lock members or with glue (in the non-hinge embodiment). Further, cap element 20 includes a outwardly extending ledge 28 for covering pad 24 which extends outward from carrying device 10 and away from a neck of a person. It is understood that article carrying device 10 can be used without cap element 20 but employing pad 24. Or, used without pad 24 but employing cap element 20. In an alternate embodiment, carrying device 10 employs a pad 24 which extends outwardly on both sides of middle portion 16 and accordingly employs ledges 28 on both sides of middle portion 16. However, in the preferred embodiment, pad 24 extends outward from only one side as shown in FIG. 1.

With continuing reference to FIG. 1, article carrying device 10 employs a plurality of clips 30 positioned at distal ends, 32 and 34 respectively, of front and back end members 12 and 14. In the preferred embodiment, as shown in FIG. 1, a pair of clips 30 are employed on each of the front and back end member 12 and 14. Clips 30 are constructed as snaps for retaining articles to carrying device 10 as shown in FIG. 2.

With reference to FIG. 2, it is shown that article carrying device 10 is employed on a shoulder 36 of a person 38. Front and back end members, 12 and 14, of carrying device 10 extend outwardly from a front and back side of person 38, positioned on a single shoulder 36 of person 38. Carrying device 10 does not rest across both shoulders and around the back of the neck as seen in the prior art. However, carrying device 10 is interchangeable (or reversible) and can be employed on either the right or left shoulder of person 38 depending on user preference or strength of the particular shoulder. In FIG. 2, carrying device 10 is shown to be employed on the right shoulder 36 of person 38.

Figure 4:
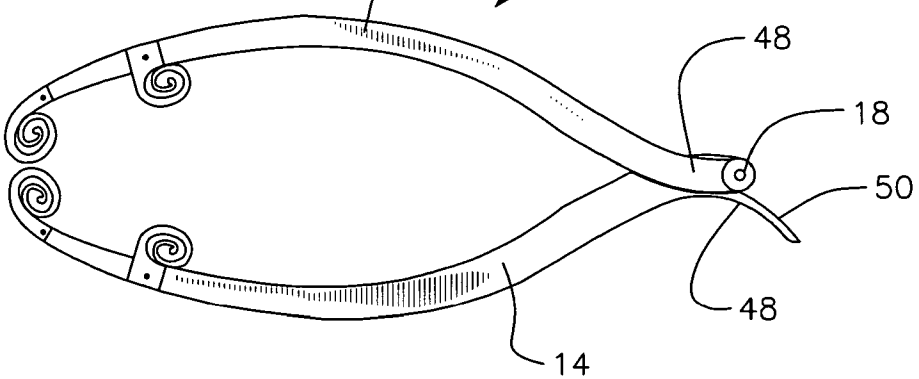
FIG. 4 is a right side view of the interchangeable shoulder mountable article carrying device of the present invention in a collapsed position about the hinge.

With reference now to FIG. 3, article carrying device 10 is shown having hinge mechanism 18 positioned at an apex 42 of middle portion 16. Hinge mechanism 18 allows carrying device 10 to be employed for use as shown in FIG. 3, or collapsed for storage as shown in FIG. 4. As illustrated in FIG. 4, hinge mechanism 18 allows front end member 12 to fold back upon back end member 14. A cut-out section 44 formed in a proximal end 46 of back end member 14 permits a proximal end 48 of front end member 12 to rotate about hinge mechanism 18 and collapse front and back end members 12 and 14 together. Further, back end member proximal end 46 includes a stop portion 50 extending underneath front end member proximal end 48 for stopping front end member 12 at it's fully extended and employed position (as shown in FIG. 3). The shape of cut-out 44 provides a stop for front end member 12 when it is folded into the collapsed position as shown in FIG. 4.

Figure 5:
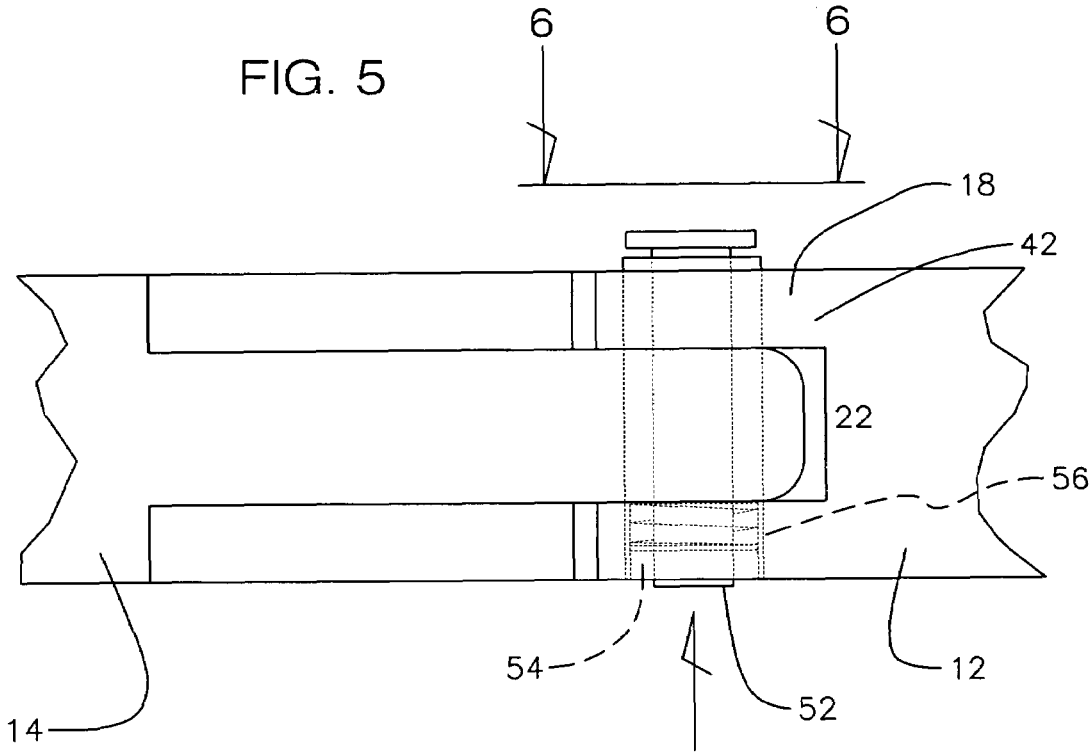
FIG. 5 is a partial top plan view of the present invention illustrating a locking element, partially in phantom, used to maintain the article carrying device in an open and employable position, the locking element located at the hinge mechanism.
Figure 6:
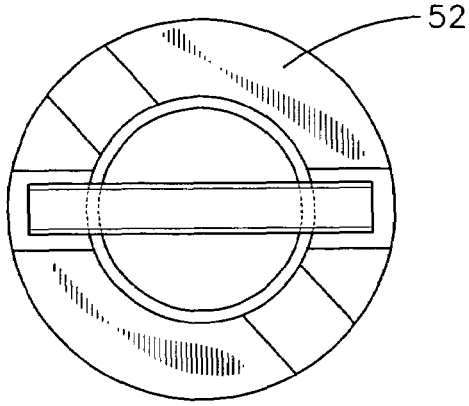
FIG. 6 is a top plan view of the locking element along lines 6-6 of FIG. 5.

With reference now to FIG. 5, a partial top plan view of article carrying device 10 is depicted. In particular, hinge mechanism 18 is shown wherein a pin 52 is inserted through a bore 54 formed in apex 42 of article carrying device 10. Pin 52 secures front and back end members, 12 and 14, together in a locked position in either the employed position (as shown in FIG. 3) or in the collapsed position (as shown in FIG. 4). As shown in FIGS. 5 and 6, pin 52 can be pulled upward against spring 56 to release the hinge mechanism 18 thereby allowing a user to extend article carrying device 10 into it's open or collapsed positions. Of course, in the embodiment wherein article carrying device 10 is formed by a single static piece, hinge mechanism 18 and pin 52 are not employed.

Figure 7:
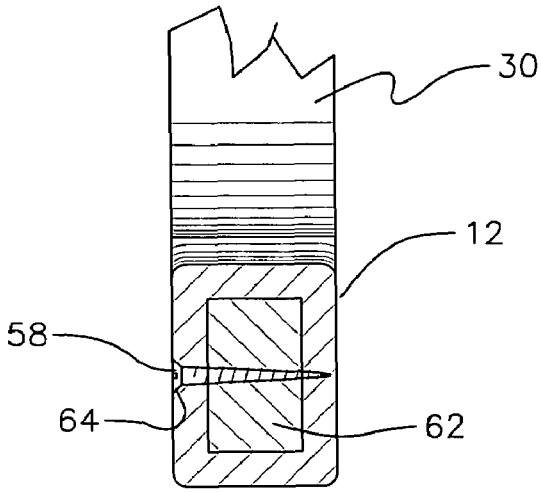
FIG. 7 is a cross sectional view along lines 7-7 of FIG. 3.

With reference now to FIG. 7, it is shown, by this cross-sectional view taken along lines 7-7 of FIG. 3, that clips 30, in the preferred embodiment, are fastened to article carrying device 10 by a screw 58. In an alternate embodiment, clips 30 are integral with front and back end members 12 and 14.

Figure 8:
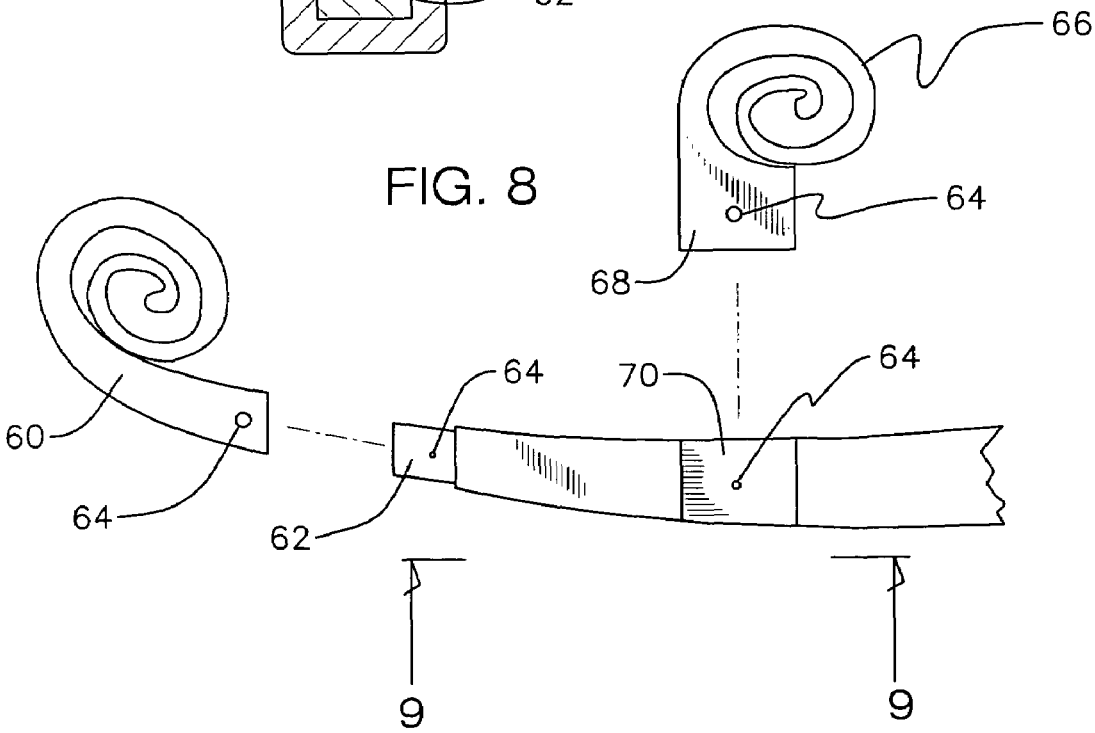
FIG. 8 is a partial side view of a distal end of an end member of the present invention, illustrating how clips are attached to the carrying device.
Figure 9:
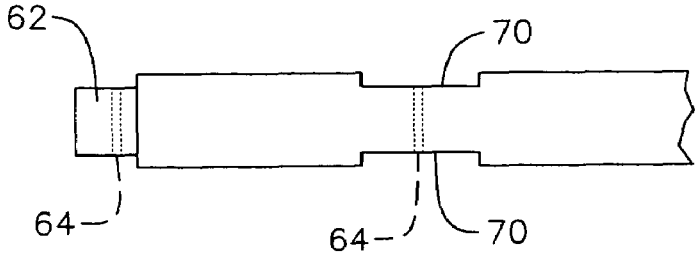
FIG. 9 is a partial bottom plan view along lines 9-9 of FIG. 8.

With reference to FIGS. 8 and 9, it is shown that clips 30 are attached to front and back end members 12 and 14 by inserting around cut-away portions formed therein. In particular, an outer clip 60, having a female part, inserts around a male portion 62 provided along the distal end of the end member. A bore 64 formed through outer clip 60 and through the male portion 62, in axial alignment, receives screw 58 for attaching outer clip 60 to carrying device 10. Further, an inner clip 66 having a pair of downwardly extending parallel walls 68 insert around a recessed portion 70 provided near the respective end member distal end. A bore 64 formed through inner clip 66 and recessed portion 70, in axial alignment, receives screw 58 for attaching inner clip 66 to carrying device 10.

Use of article carrying device 10 is illustrated in FIG. 2, wherein person 38 balances device 10 upon his shoulder 36. Packages 72, of substantially equal weights, are supported on carrying device 10 and held in place by clips 30. If the packages 72 are of unequal weights, person 38 could attached the heavier of the two packages to the inner clip of the front member and the lighter of the two packages to the outer clip of the back member thereby bringing the center of gravity back to a center point along the person's body resulting in a balancing of article carrying device 10. In an alternate embodiment, not shown, front and back end members 12 and 14 could be provided with telescopic portions to lengthen either end member to account for unequal weighted articles or packages.

Equivalent elements can be substituted for the ones set forth above such that they perform the same function in the same way for achieving the same result.

Having thus described the invention, what is claimed and desired to be secured by Letters Patent is:

1. An article carrying device mounted on a single shoulder of a person's body for carrying packages of substantially equal weights, the device comprising:

a) an elongated member having a front end portion extending perpendicularly outwardly from a front portion of the person's body, a middle portion, and a back end portion extending perpendicularly outwardly from a rear portion of the person's body, the elongated member mounted on top of the person's shoulder without the need of any straps, b) the middle portion having an upwardly bowed shape providing an apex of the article carrying device, the middle portion cradled upon a top portion of the single shoulder, c) the front and back end portions extending out from the middle portion in opposing directions such that each front and back end portions curve downwardly from the article apex and then thereafter upwardly at respective distal ends of each front and back end portion, d) the front and back end portions having a plurality of article securing clips positioned near the respective distal ends of each of the front and back end portions of the elongated member, e) the plurality of article securing clips extending upwardly from a top portion of the elongated member, each formed as a spiral, f) a hinge provided at the middle portion separating the front and back end portions of the elongated member for permitting the article carrying device to be positioned in an open or collapsed state, the front and back end portions pivotable about the hinge, and g) a shoulder pad mounted on an underside of the middle portion, directly below the hinge.

2. The article carrying device of claim 1, further comprising a stop ledge of the back end portion for prohibiting the front end portion from extending any further when the article carrying device is employed in its open and useable state, the stop ledge extending out and downwardly from a proximal end of the back end portion directly underneath the article carrying device apex.

3. The article carrying device of claim 1, further comprising a cutout portion formed in a proximal end of the back end portion, enabling the front end portion to fold there within when the article carrying device is employed in its collapsed state.

4. The article carrying device of claim 1, further comprising a pin inserted through a bore formed in the hinge for locking the article carrying device in either an open or collapsed state.

5. The article carrying device of claim 1, further comprising a cap element mounted over a top side of the middle portion.

6. The article carrying device of claim 1, wherein four clips are provided, two clips positioned on the front end portion and two clips positioned on the back end portion of the elongated member.

7. The article carrying device of claim 1, wherein the plurality of clips are integrally formed with the article carrying device along the elongated member.

8. The article carrying device of claim 1, wherein the plurality of clips are removably attached to the article carrying device by screws inserted within bores formed in each of the clips and the article carrying device and which are axially aligned.

9. The article carrying device of claim 1, wherein a portion of the shoulder pad extends outward from the underside of the article carrying device in one direction towards a person's outer shoulder when the article carrying device is employed thereupon.

10. The article carrying device of claim 9, further comprising a cap element mounted over a top side of the middle portion, the cap element having a ledge extending outwardly and covering the portion of the shoulder pad that extends outwardly from the underside of the article carrying device.

* * * * *